US006660972B1

(12) United States Patent
Georgii

(10) Patent No.: US 6,660,972 B1
(45) Date of Patent: Dec. 9, 2003

(54) CONTAINER FOR STORING HAZARDOUS MATERIAL AND A METHOD OF ENCLOSING HAZARDOUS MATERIAL IN A CONCRETE CONTAINER BODY

(75) Inventor: Hans Georgii, London (GB)

(73) Assignee: Oyster International N.V., Curacao (AN)

( * ) Notice: Subject to any disclaimer, the term of this patent is extended or adjusted under 35 U.S.C. 154(b) by 0 days.

(21) Appl. No.: 09/959,462

(22) PCT Filed: Apr. 26, 2000

(86) PCT No.: PCT/SE00/00783

§ 371 (c)(1),
(2), (4) Date: Oct. 26, 2001

(87) PCT Pub. No.: WO00/65604

PCT Pub. Date: Nov. 2, 2000

(30) Foreign Application Priority Data

Apr. 26, 1999 (SE) ..... 9901491

(51) Int. Cl.[7] ..... B65D 55/00; G21F 5/12; H05B 3/06; F27D 1/02; F27D 1/18

(52) U.S. Cl. ..... 219/385; 219/213; 219/415; 250/506.1; 376/272; 220/201

(58) Field of Search ..... 219/385, 201, 219/213, 415; 220/201; 250/506.1, 507.1; 376/272

(56) References Cited

U.S. PATENT DOCUMENTS

| | | | | |
|---|---|---|---|---|
| H152 H | * | 11/1986 | Lampe | 376/272 |
| 4,738,388 A | | 4/1988 | Bienek et al. | |
| 4,847,009 A | * | 7/1989 | Madle et al. | 376/272 |
| 5,061,858 A | * | 10/1991 | Mallory | 250/507.1 |
| 5,457,263 A | * | 10/1995 | Berglund | 588/3 |
| 5,995,573 A | * | 11/1999 | Murray, Jr. | 376/272 |
| 6,299,950 B1 | * | 10/2001 | Byington et al. | 376/272 |

FOREIGN PATENT DOCUMENTS

| | | |
|---|---|---|
| DE | 31 07 611 A1 | 9/1982 |
| DE | 35 15 871 A1 | 11/1986 |
| DE | 449272 | 4/1987 |

* cited by examiner

*Primary Examiner*—Joseph Pelham
(74) *Attorney, Agent, or Firm*—Browdy and Neimark, P.L.L.C.

(57) ABSTRACT

A container for storing hazardous material and a method of enclosing hazardous material in a concrete container body defining a storage space and having an access opening for introducing the hazardous material in the storage space comprises fluid-tight sealing of the storage space by introducing a closure body of concrete in the opening subsequent to the introduction of the hazardous material. The closure body is formed by casting concrete in the access opening subsequent to the introduction of the hazardous material in the storage space and allowing the concrete to harden while supplying heat to the portion of the concrete container body surrounding the access opening.

15 Claims, 2 Drawing Sheets

CONTAINER FOR STORING HAZARDOUS MATERIAL AND A METHOD OF ENCLOSING HAZARDOUS MATERIAL IN A CONCRETE CONTAINER BODY

REFERENCE TO RELATED APPLICATIONS

The present application is the national stage under 35 U.S.C. 371 of international application PCT/SE00/00783, filed Apr. 26, 2000 which designated the United States, and which international application was published under PCT Article 21(2) in the English language.

This invention relates to storage of hazardous materials, especially low-level radioactive materials and chemical or biological hazardous materials. More particularly, the invention relates to a container for storing such materials, whether waste or useful materials, in a sealed storage space and a method for fluid-tight enclosure of the hazardous materials in a container body of concrete.

Prior art techniques for containing radioactive materials, such as fuel elements for nuclear reactors, include enclosing the materials in a shipping or storage container of reinforced concrete (DE-A-35 15 871). The radioactive material is introduced in a generally cylindrical monolithic container body with a vertically elongate storage space and an access opening connecting the storage space with the exterior surface of the container body at one end thereof. Apart from this opening the storage space is jointless.

After the radioactive material has been introduced in the storage space through the access opening, a pre-cast concrete closure body is placed in the access opening and bolted to the container body. A sealing member positioned in the gap between the wall of the access opening and the closure body ensures that the containment of the radioactive material will be fluid-tight.

In this prior art shipping and storage container, the sealing member is a factor of uncertainty. Although the sealing member may initially provide an adequate sealing, it may in the course of time lose some or all of its sealing ability, e.g. under the influence of the stored material.

An object of the invention is to ensure in a concrete container for storing a hazardous material a satisfactory containment of the material for a very long time, such as several decades.

In the container and the method according to the invention, the features of which are set forth in the claims, this object is achieved by casting concrete in an access opening of a container body after the introduction of the hazardous material in a storage space formed by the container body through the access opening and allowing the concrete to harden while supplying heat to the portion of the container body which surrounds the access opening. The supply of heat will cause the access opening to be expanded as a result of the thermal expansion of the heated portion of the container body. After a suitable heating period, the heated portion is allowed to assume the ambient temperature and thereby provide a shrink fit with the closure body formed by the hardened concrete cast in the access opening.

The shrink fit will be particularly effective if the container body comprises a metal reinforcement, preferably a prestressed reinforcement, extending about the access opening and this reinforcement is heated together with the concrete.

Preferably, the heating is accomplished by a heater, e.g. an electric heater, embedded in the concrete and extending about the access opening.

The container and the method of the invention will be described in more detail with reference to the illustrative exemplary embodiment of a container for storing hazardous materials shown in the drawings.

Figure 1:
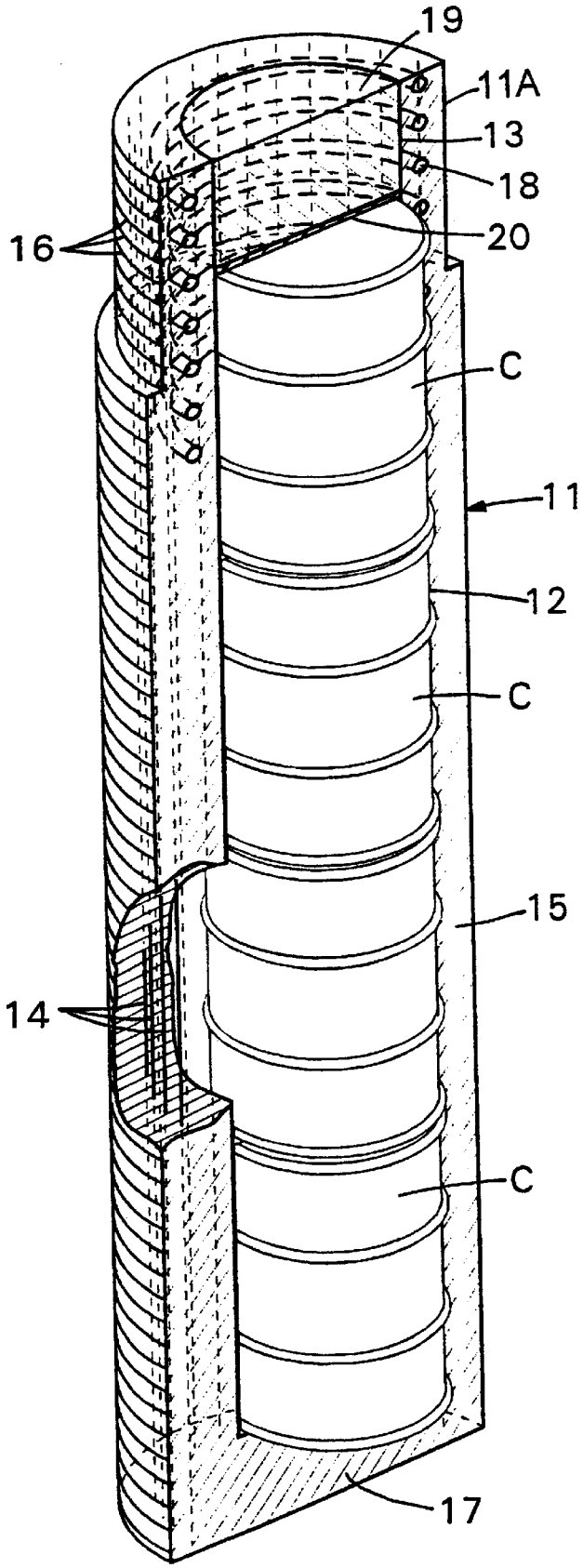
FIG. 1 is a vertical sectional view of the container.
Figure 2:
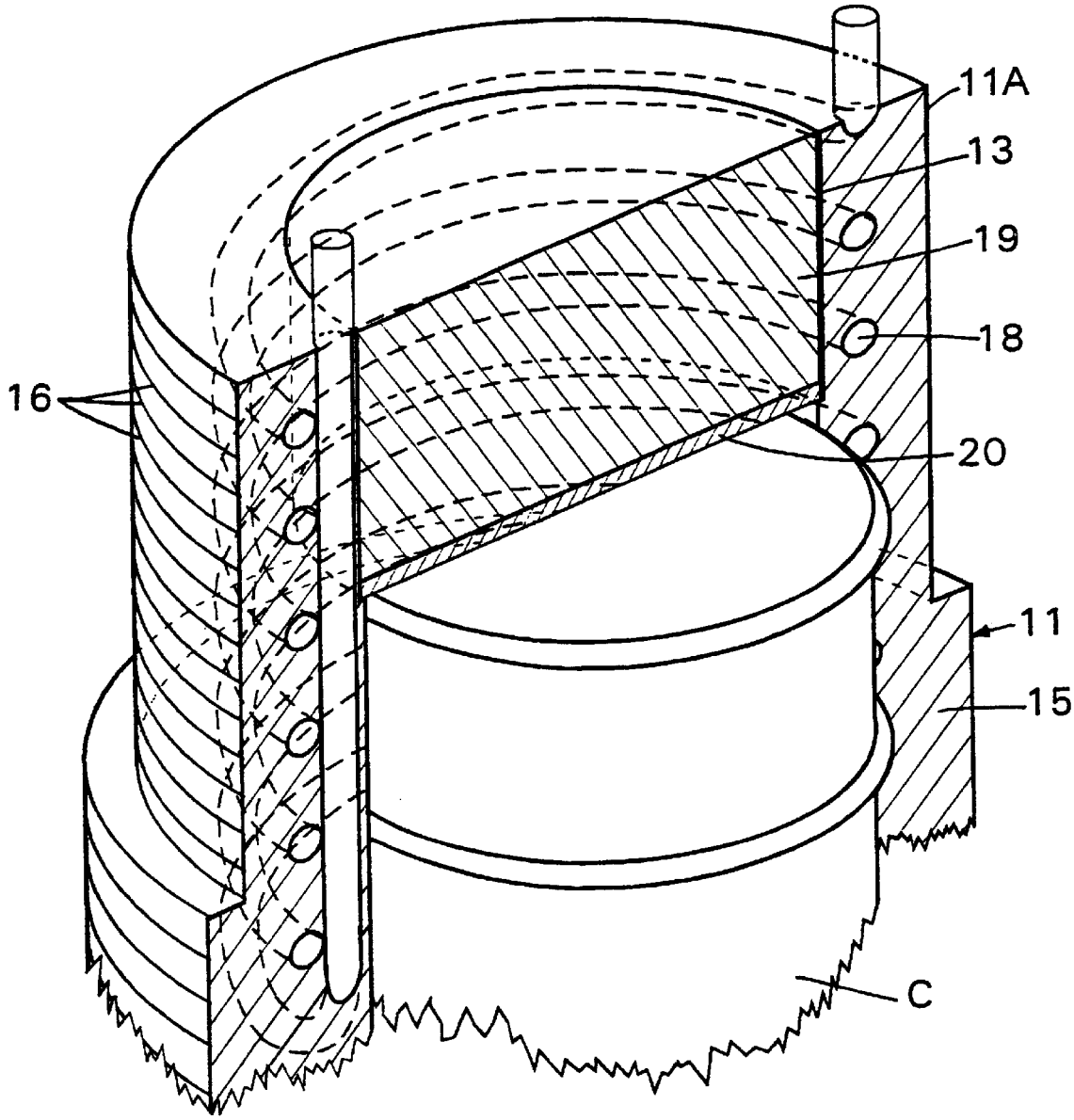
FIG. 2 is an enlarged sectional view of the container shown in FIG. 1.

In the illustrated exemplary embodiment, the container according to the invention comprises a circular cylindrical container body 11 shown in its normal upright position in the drawings. The container body 11 is a monolithic body of concrete and forms a central, likewise circular cylindrical storage space 12. A tubular mouth portion 11A at the upper end of the container body 12 defines an access opening 13. Through this opening 13 material to be enclosed in the container body 11 and held in it for a shorter or longer time can be introduced in the storage space 12 and removed therefrom if required. The access opening 13 forms an upward extension of the storage space 12.

As shown in the drawings, the container body 11 has been sealed in accordance with the method of the invention after a number of inner vessels C containing hazardous material have been stacked in the storage space 12. The hazardous material may be radioactive material, particularly low-level radioactive material, chemical or biological material or any other material that has to be stored such that it is reliably prevented from escaping from the container body.

The container body 11 is provided with both an axial steel reinforcement 14 embedded in the wall 15 of the container body and a further reinforcement 16 formed by a steel wire wound about the cylindrical outer surface of the wall 15. A steel reinforcement (not shown) is also embedded in the bottom wall 17 of the container body 11. All reinforcements may be prestressed.

A heater 18 is embedded in the upper portion of the container body 11, including the mouth portion 11A. Preferably, the heater 18 is an electrical heater, but the heating energy supplied to the heater for heating the upper portion of the container body 11, and especially the mouth portion 11A, may also be non-electric energy. Associated with the heater 18, but not shown in the drawings, are means for connecting the heater to an energy source and means for controlling and monitoring the heating.

In the illustrated embodiment, the heater 18 is in the shape of a cylindrical helix which is coaxial with the wall 15 of the container body 11, the storage space 12 and the access opening. The heater axially subtends the portion of the container body wall 15 which defines the access opening 13, that is, the mouth portion 11A, and an adjoining axial section of the portion of the wall which defines the storage space 12. Over that section the pitch of the helical heater may increase gradually in the direction away from the mouth portion 11A so that the heating power per unit volume of the concrete will be lower than in the mouth portion. During the heating a temperature gradient will thus develop in the concrete beneath the mouth portion 11A.

After the vessels C have been inserted in the storage space 12, a fluid-tight sealing of the container body 11 is accomplished by casting a closure body 19 of concrete in the access opening 13. A plate 20 inserted in the access opening 13 prior to the casting of the concrete forming the closure body 19 limits the space occupied by the concrete. This plate may be omitted, however, so that the concrete poured into the access opening 13 to form the closure body 19 can reach the vessels C and also fill the gap between the vessels and the container body wall 15, thereby immobilising the vessels in the storage space 12.

To seal the container body 11, concrete is poured into the access opening 13 and at the same time, or some time before the pouring, the heater is energised to heat the upper portion of the container body 11 and thereby expand it, including the reinforcement 16, so that the access opening 13 is widened. The cast and still wet concrete is vibrated intensely and then revibrated after a few hours so that a very intimate contact between the concrete of the container body 11 and the concrete of the closure body 19 is brought about.

During the first phase of the hardening of the concrete of the closure body 19 it may be advantageous to cool the wet concrete. This can be done by sticking cooling rods or other cooling members into the still viscous concrete.

When the concrete in the access opening 13 has hardened sufficiently, the heating is discontinued so that the temperature of the upper portion of the container body 11 will be reduced and the mouth portion 13 will thereby be somewhat constricted and subject the closure body 19 formed in the access opening to an omnidirectional radial pressure. This pressure will enhance the bond between the closure body 19 and the mouth portion 19 surrounding it so that a perfectly fluid-tight and permanent sealing results. If desired, the heating can be controlled such that the temperature of the concrete of the mouth portion 11A varies in dependence on the progress of the hardening of the concrete forming the closure body 19. Preferably, the mouth portion 11A is heated to a temperature within a predetermined temperature range while the adjoining section of the container body 11 is heated to a temperature that drops from the first-mentioned temperature adjacent the mouth portion 11A to the ambient temperature adjacent the lower end of the heater 18.

The container body 11 can be manufactured centrally and stored in suitable numbers for future use. All that is required to contain the hazardous material after it has been introduced in the storage space 12 of the container body 11 is to cast concrete in the access opening 13 to form the closure body 19 and control the heating of the upper portion of the container body. These sealing operations can readily be carried out at any suitable location, e.g. where the hazardous material to be contained is kept.

As is apparent from the foregoing description, the sealed closure body 19 cannot be easily removed. However, should it be necessary to open the sealed container body 11 to gain access to the contained hazardous material, opening can be accomplished with a reasonable effort by cutting away the closure body 19 using chiselling or other fragmenting tools. A container body opened in this way may be reused.

What is claimed is:

1. A container for storing hazardous material in a closed storage space, comprising a concrete container body (11) forming the storage space (12) and having a mouth portion (11A) defining an access opening (13) for insertion of the hazardous material (C), and a concrete closure body receivable in the opening to form a fluid-tight seal for the storage space (12), characterized by a heater (18) disposed in the container body (11) around the access opening (13) for heating the mouth portion (11A), and the container body being reinforced by a circumferential metal reinforcement (16) at the mouth portion (11A) of the container body (11), the reinforcement being disposed within the heating range of the heater (18), whereby it will be heated as a result of the heating of the mouth portion (11A).

2. A container as claimed in claim 1, in which the heater (18) extends substantially throughout the mouth portion (11A) and past the mouth portion into the adjoining portion of the container body (11).

3. A container as claimed in claim 1 or 2, in which the heater (18) is adapted to heat the container body (11) to a first temperature within the mouth portion (11A) and to a second temperature within the adjoining portion of the container body, the first temperature being in a predetermined temperature range and the second temperature diminishing gradually from the first temperature in the direction away from the mouth portion (11A).

4. A container as claimed in claim 1, in which the heater (18) extends helically around the access opening (13) within the mouth portion (11A) of the container body (11).

5. A container as claimed in claim 1, in which the container body (11) is substantially cylindrical and in which the access opening (13) is formed at one end of the container body and forms an extension of the storage space (12).

6. A method enclosing of enclosing hazardous material in a concrete container body (11) defining a storage space (12) and having an access opening (13) for introducing the hazardous material (C) in the storage space, comprising fluid-tight sealing of the storage space (12) by introducing a closure body (19) of concrete in the access opening (13) subsequent to the introduction of the hazardous material, characterized by casting concrete in the access opening (13) subsequent to the introduction of the hazardous material (C) in the storage space (12), and allowing the concrete to harden while supplying heat to the portion (11A) of the concrete container body (11) surrounding the access opening (13).

7. A method as claimed in claim 6, in which the heat is supplied by means of a heater (18) disposed in the portion (11A) of the concrete container body (11) surrounding the access opening (13).

8. A method as claimed in claim 6 or 7, in which the heating of the portion (11A) of the concrete container body (11) surrounding the access opening (13) includes heating of a metal reinforcement (16) of said portion, the reinforcement extending about the access opening.

9. A method according to claim 6 or 7, in which the temperature of the portion (11A) of the concrete container body (11) surrounding the access opening (13) is controlled in dependence on the progress of the hardening of the concrete cast in the access opening (13).

10. A method according to claim 6 or 7, in which the concrete cast in the access opening (13) is cooled during the initial phase of the hardening of the concrete.

11. A method according to claim 6 or 7, in which the concrete cast in the access opening (13) is intensely vibrated immediately following the casting.

12. A container for storing hazardous material in a closed storage space, comprising a concrete container body (11) forming the storage space (12) and having a mouth portion (11A) defining an access opening (13) for insertion of the hazardous material (C), and a concrete closure body receivable in the opening to form a fluid-tight seal for the storage space (12), characterized by a heater (18) disposed in the container body (11) around the access opening (13) for heating the mouth portion (11A), in which the heater (18) extends substantially throughout the mouth portion (11A) and past the mouth portion into the adjoining portion of the container body (11).

13. A container as claimed in claim 12, in which the heater (18) is adapted to heat the container body (11) to a first temperature within the mouth portion (11A) and to a second temperature within the adjoining portion of the container body, the first temperature being in a predetermined temperature range and the second temperature diminishing gradually from the first temperature in the direction away from the mouth portion (11A).

14. A container as claimed in claim 12, in which the heater (18) extends helically around the access opening (13) within the mouth portion (11A) of the container body (11).

15. A container as claimed in claim 12, in which the container body (11) is substantially cylindrical and in which the access opening (13) is formed at one end of the container body and forms an extension of the storage space (12).

* * * * *